US005934934A

United States Patent [19]

Ward

[11] Patent Number: 5,934,934

[45] Date of Patent: Aug. 10, 1999

[54] SHIELDED COUPLERS

[75] Inventor: Donald A. Ward, Danube, Minn.

[73] Assignee: Communication Systems, Inc., Hector, Minn.

[21] Appl. No.: 08/956,627

[22] Filed: Aug. 4, 1997

Related U.S. Application Data

[63] Continuation-in-part of application No. 08/837,810, Apr. 22, 1997, abandoned.

[51] Int. Cl.[6] ..... H01R 13/52

[52] U.S. Cl. ..... 439/521; 439/620; 439/936

[58] Field of Search ..... 439/521, 620, 439/519, 936

[56] References Cited

U.S. PATENT DOCUMENTS

| | | | |
|---|---|---|---|
| 4,598,165 | 7/1986 | Tsai | 174/36 |
| 4,992,060 | 2/1991 | Meyer | 439/620 |
| 4,998,894 | 3/1991 | Gronvall | 439/521 |
| 5,085,597 | 2/1992 | Story et al. | 439/521 |
| 5,111,497 | 5/1992 | Bliven et al. | 379/27 |
| 5,122,227 | 6/1992 | Ott | 156/659.1 |
| 5,201,672 | 4/1993 | Story et al. | 439/521 |
| 5,226,837 | 7/1993 | Cinibulk et al. | 439/521 |
| 5,246,383 | 9/1993 | Shimirak et al. | 439/521 |
| 5,376,019 | 12/1994 | Shimirak et al. | 439/521 |
| 5,406,702 | 4/1995 | Shimirak et al. | 29/883 |
| 5,427,547 | 6/1995 | Shimirak et al. | 439/521 |
| 5,500,629 | 3/1996 | Meyer | 333/181 |
| 5,525,073 | 6/1996 | Sampson | 439/521 |
| 5,562,491 | 10/1996 | Shimirak et al. | 439/521 |
| 5,639,989 | 6/1997 | Higgins, III | 174/35 MS |

*Primary Examiner*—Gary F. Paumen

*Attorney, Agent, or Firm*—Westman, Champlin & Kelly, P.A.

[57] ABSTRACT

A connector for connecting electrical wires includes a housing or enclosure that surrounds contacts for making a connection to a plug. The housing is filled with a colloidal gel environmental protection material that includes particles that will absorb electromagnetic radiation, particularly in the radio frequency range to form a colloidal gel. The gel can be any one of the existing polyurethane, or silicone based gels used for environmental protection of connectors, such as telephone jacks. The particles are preferably made from either Parites or ferrites and range in size from 5 microns to 100 microns. The loading of the particles can be between 5% and 80% of the overall weight of the finished colloidal gel. The colloidal gel can be formed so that it is sufficiently cohesive to form into strips that can be wrapped around connectors as well.

13 Claims, 1 Drawing Sheet

SHIELDED COUPLERS

CROSS REFERENCE TO RELATED APPLICATION

This application is a continuation-in-part of my application Ser. No. 08/837,810, filed Apr. 22, 1997 for shielded couplers, now abandoned.

BACKGROUND OF THE INVENTION

A shielded coupler, such as an electrical connector, is provided with a colloidal form of gel fill that includes granular powdered particles of electromagnetic shielding material, such as Parites and ferrites, in sufficient density to absorb radio frequency energy. The filling of colloidal gel maintains the shielding material in the form of small discrete particles in suspension that provides a re-enterable electrical connection.

Various gel filled connectors have been advanced, including those which are used in the communications field for protecting the contacts in a communication line socket and plug from the environment. The gels can be selected to have various degrees of viscosity, and will move away from the contacts as a plug is inserted into a socket, but also generally will have enough body to reseal and cover the contacts when a plug is removed.

The gels that are used range across quite a wide range of viscosity. A gel that will work for the present invention is a polyurethane gel sold by CasChem, Inc., 40 Avenue A, Bayonne, N.J. 07002 under the trademark QURE as System 172 X-Linked Polyurethane Gel. It is a combination of Vorite 3035 and Polycin 3540, both of which are products sold under those registered trademarks. The colloidal form of gel is of a medium viscosity, amber in color with a high cone penetration value. The colloidal gel is such that it can be pressed around or penetrated by fixtures intended to be protected from environmental exposure and it has a high level of tack so as to bond to itself or to contacts and surfaces of a connector. The colloidal gel will separate to permit some component, such as a plug, to be inserted into the connector. Gels without a shielding material filling are used as a sealing compound for various electrical devices and cables.

A gel filled electrical connector that utilizes an elastic diaphragm for urging the gel into place when a plug is removed from a socket is shown in U.S. Pat. No. 5,246,383, by way of example.

A shielding and filtering additive, sold under the trademark "Parite" is part of a family of fired body materials manufactured by Steward Incorporated, 12 E. 36th Street, Chattanooga, Tenn. The material is a substantially homogenous mixture of manganese oxide and iron oxide powder. The use of Parite particles in other electrical devices, such as noise suppressors, is disclosed in U.S. Pat. No. 5,500,629. Some uses are described under the heading "objectives" at column 4, lines 27–43 of U.S. Pat. No. 5,500,629. Ferrites include a mix of oxides of manganese and iron, that can be modified by oxides of zinc, nickel and other metals. Ferrites are powdered or disintegrated ferrous-based materials.

SUMMARY OF THE INVENTION

The present invention relates to a protective colloidal gel that is used for filling connectors and couplers for electrical conductors, both for communication and other uses, that will protect the connector from environmental damage, and at the same time will provide electromagnetic shielding and filtering to reduce noise from external sources. The colloidal gel can be of any desired presently known form, which generally maintains its shape to which it is formed. The gel of the present invention is filled with a substantially uniformly dispersed filling of fine discrete particles that absorb electromagnetic or radiant energy. Preferably the particles are made of Parites and ferrites, which can be milled to a very fine state and mixed in with the gel during the manufacturing process so that the shielding material is substantially uniformally dispersed in the gel to form a colloidal gel and remains dispersed as the colloidal gel cures.

Up to a 55% loading of the particles by weight is achieved quite easily. The consistency is then 55% of the ferrite, Parite, or other shielding particles and 45% of the base gel by weight. The filling of particles can go up to 80% by weight so long as the colloidal gel remains sufficiently elastic so that it does not separate when the connector sections are connected or disconnected.

The shielding colloidal gel (with particles in it) has a fairly high resistance, and will generate a substantial amount of heat when absorbing and reflecting radiant energy, so that the couplers do reach a relatively high temperature.

In addition to polyurethane gels, various oils and synthetic polymers that have a sufficient molecular construction so that they will suspend particles such as Parite particles or ferrites can be used. The suspending material should be a material that does not react with electrical contacts or other components in a splice or connector, and has a relatively long life.

DETAILED DESCRIPTION OF THE PREFERRED EMBODIMENTS

Figure 1:
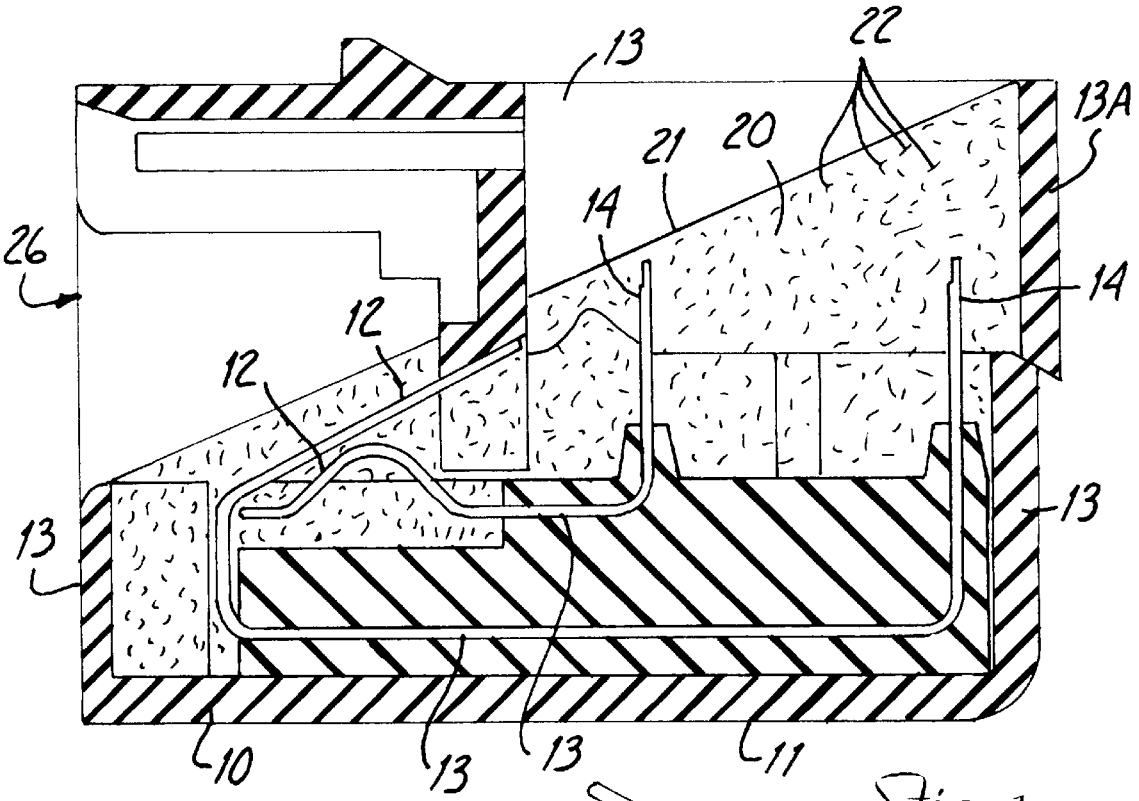
FIG. 1 is a schematic sectional view of a typical communication connector having a colloidal gel filling made according to the present invention.

In FIG. 1, a housing 10 includes a number of spring contacts 12 comprising output terminals of conductors 13 that are connected to a plurality of input terminals shown only generally at 14 which are connected to twisted pairs of communication wire, such as telephone or data lines (not shown). The interior of the housing is filled to surround the conductors 13, the spring contacts 12, and the input terminals 14 with a colloidal gel illustrated at 20. The housing has a bottom wall 11 and upright side and end walls 13 to form an enclosure. The showing in FIG. 1 is with the connector partially assembled. A wall section 13A is broken away after the set is filled to a fill line 21, and a load bar for carrying wires is put into place to connect the wires to input terminals 14. The colloidal gel will be squeezed around the input terminals and the wire connections.

The colloidal gel is filled with discrete particles 22 that are capable of electrically shielding the conductors inside the housing 10, by absorbing radiant energy such as electromagnetic radiation and the like that might be picked up on the contacts and conductors from the exterior of the housing 10. Such radiation causes electrical noise that interferes with communication signals. When Parite particles are used there is filtering as well.

The colloidal gel filling 20 including the particles 22 is selected so that the particles are preferably Parite particles and ferrites which will absorb radiant energy in the radio frequency range. Thus, when a plug is inserted into the housing at a plug opening 26, the contacts in the housing and the contacts in the plug are shielded by the shielding colloidal gel. This eliminates the use of any exterior shielding such as films or sheets added to the housing surfaces. The particle loaded colloidal gel reduces the noise and other interference in the transmitted signals.

Figure 2:
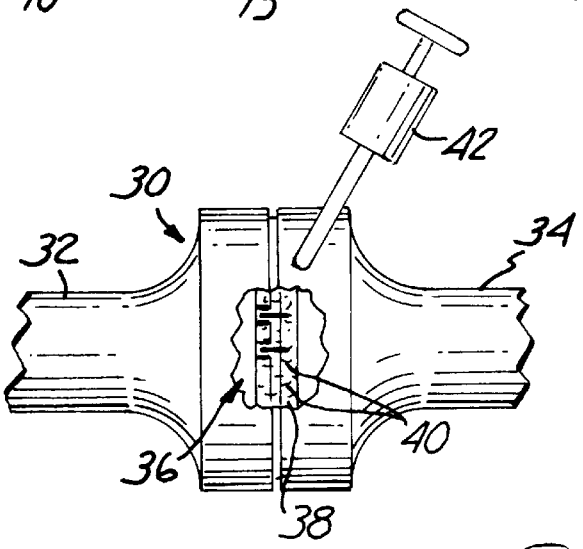
FIG. 2 is a schematic representation of an electrical connector in which colloidal gel filling of the present invention is used.

An electrical connector indicated generally at 30 is shown at FIG. 2. This can be for an electrical connector used with a pair of shielded cables 32 and 34, such as in an automobile. The colloidal gel is placed in the contact region indicated at 36. The filling of colloidal gel 38 that has suspended particles 40 of material, preferably a parite or ferrite therein, provides shielding at the connector so the connector and cables are both shielded. The connector can be filled after assembly using an injector 42 to inject the colloidal gel into the contact region. The injector is similar to the injector shown in U.S. Pat. No. 5,246,383. A suitable opening for injection of the shielding colloidal gel is provided in the connector. Thus, the colloidal gel of the present invention can be applied to existing products as well as new products.

The same shielding can be achieved by utilizing a particle filled colloidal gel formed into a mat or layer which is wrapped around a splice in a cable. The colloidal gel contains ferrite or parite particles to provide radio frequency shielding. The base gel is selected from known gels (see U.S. Pat. No. 5,246,383) with particles added to form a colloidal gel. The colloidal gel is capable of self supporting, and has the ability to adhere to surfaces with a strength that is less than the cohesive strength, so that the colloidal gel can be wrapped, separated, and then resealed. A strip or layer of the colloidal gel, such as a polymer containing the discrete shielding particles (parite or ferrite particles) can be formed into a strip and then used as a wrapping in a splice area of a cable.

The QURE System 172 X-Linked Polyurethane Gel made by CasChem, Inc. has been found to be suitable. It is processed to have a cone penetration with a 1/10 mm ball of 295 under test ASTM D217, and has an insulation resistance of $5.4\times10^{10}$ ohms. The shielding particles are added forming a colloidal gel when the base polyurethane gel is being processed, preferably when the gel is in a state where it can be mixed and yet hold the particles in suspension to form a colloidal gel.

The selection of the base gel is within the skill of the workers in the field, in view of the prior gel filled connectors, and the addition of the Parite or ferrite particles, or other shielding material particles is done during processing. A silicone or polyurethane base gel filled with particles of Parite or ferrite having a maximum screen size of 5 microns, up to in the range of a maximum screen size of 100 microns and represented by between 10% and 80% by weight to form a colloidal gel, provides adequate shielding. External noise, particularly in high frequency communication systems is reduced at the coupling or connector. The colloidal gel is re-enterable, by a plug; that is, a plug can penetrate the colloidal gel and separate it so that the contacts on the plug make contact with spring contacts in a colloidal gel filled housing such as that shown at 10. When the plug is removed, the colloidal gel will flow back together. The colloidal gel will receive another plug subsequently inserted in the connector housing.

The shielding colloidal gel also can be used around splices in communication lines to shield the splices. A clam shell type housing filled with colloidal gel can be clamped over a splice to achieve shielding or the colloidal gel can be wrapped around the splice or packed around the splice.

Electrical filtration properties are achieved within the connector body when high percentages of Parite particles by weight, are utilized in the colloidal gel.

Although the present invention has been described with reference to preferred embodiments, workers skilled in the art will recognize that changes may be made in form and detail without departing from the spirit and scope of the invention.

What is claimed is:

1. A shielded housing wherein at least one electrical signal carrying wire is connected to another for making internal electrical signal connections comprising:

the at least one wire comprising an electrical signal conductor in the housing and adapted for electrical connection to a second electrical conductor;

a colloidal, electrically non conductive gel material filled in the housing sufficiently for environmental isolation of the at least one signal conductor in the housing; and a filling in the colloidal gel material of an electrically non conductive shielding material divided into discrete particles and disbursed substantially throughout the colloidal gel.

2. The housing of claim 1, wherein said shielding material comprises materials selected from the group consisting of Parite particles and ferrites.

3. The housing of claim 1, wherein the housing comprises a bottom wall and side walls joining their bottom wall to form an enclosure, the enclosure being filled to a desired level with the colloidal gel.

4. The housing of claim 1, wherein the shielding material consists of particles having a screen size between 5 and 100 microns.

5. The housing of claim 1 in which the shielding material comprises one of a group consisting of Parite particles and ferrites.

6. The housing of claim 1, wherein said shielding material comprises ferrite.

7. The housing of claim 1 in which the shielding material is mixed into the gel material and comprises substantially up to 80% by weight of the combined colloidal gel material and shielding material.

8. The housing of claim 1, wherein the colloidal gel material comprises an X-Linked polyurethane having the shielding material particles embedded therein.

9. A method of electrically shielding and filtering electrical conductors comprising the steps of forming an enclosure around the electrical conductors, filling the enclosure with an electrically non conductive gel capable of sealing around the conductors in the enclosure, and providing a filling of electrically non conductive electromagnetic radiation absorbing particles in the gel.

10. The method of claim 9 including the step of adding particles in the gel in the range of between 5% and 80% by weight of the combined gel and particles.

11. The method of claim 9 including the step of adding particles made from one of the materials from the group consisting of parites and ferrites.

12. The method of claim 11 including the step of adding particles that range between 5 microns and 100 microns in screen size.

13. A connector for connecting at least one wire to another for making internal electrical connections comprising:

a housing having at least one contact therein and adapted for receiving a plug carrying a second contact to engage the one contact for electrical connection;

a colloidal, electrically non conductive gel material filled in the housing sufficiently for environmental isolation of the at least one contact in the housing; and a filling in the colloidal gel material of an electrically non conductive shielding material divided into discrete particles and disbursed substantially throughout the colloidal gel.

* * * * *